US008887674B2

(12) United States Patent
Brandl et al.

(10) Patent No.: US 8,887,674 B2
(45) Date of Patent: Nov. 18, 2014

(54) CYLINDER HEAD FOR AN INTERNAL COMBUSTION ENGINE

(75) Inventors: Thomas Brandl, Ludwigsburg (DE); Christof Knollmayr, Graz (AT)

(73) Assignee: AVL List GmbH, Graz (AT)

( * ) Notice: Subject to any disclaimer, the term of this patent is extended or adjusted under 35 U.S.C. 154(b) by 0 days.

(21) Appl. No.: 13/510,681

(22) PCT Filed: Nov. 18, 2010

(86) PCT No.: PCT/EP2010/067734

§ 371 (c)(1), (2), (4) Date: Jul. 24, 2012

(87) PCT Pub. No.: WO2011/061248

PCT Pub. Date: May 26, 2011

(65) Prior Publication Data

US 2012/0285403 A1 Nov. 15, 2012

(30) Foreign Application Priority Data

Nov. 19, 2009 (AT) ..... A 1838/2009

(51) Int. Cl.

| | |
|---|---|
| ***F02F 1/40*** | (2006.01) |
| ***F02F 1/38*** | (2006.01) |
| ***F02F 1/24*** | (2006.01) |
| *F02B 53/00* | (2006.01) |

(52) U.S. Cl.

CPC . *F02F 1/243* (2013.01); *F02F 1/40* (2013.01); *F02F 1/38* (2013.01); *F02F 1/242* (2013.01); *F02B 2053/005* (2013.01)

USPC ..... 123/41.82 R; 123/41.31

(58) Field of Classification Search

USPC ..... 123/41.31, 41.3, 41.17, 41.44, 41.57, 123/41.82 R

See application file for complete search history.

(56) References Cited

U.S. PATENT DOCUMENTS

| | | | | |
|---|---|---|---|---|
| 2,037,354 | A * | 4/1936 | Treiber | 123/41.31 |
| 2,713,332 | A * | 7/1955 | Beardsley | 123/41.28 |
| 3,160,148 | A * | 12/1964 | Giacosa et al. | 123/41.57 |
| 3,491,731 | A | 1/1970 | Dinger et al. | |

(Continued)

FOREIGN PATENT DOCUMENTS

| | | |
|---|---|---|
| AT | 500442 | 12/2005 |
| DE | 3802886 | 8/1988 |

OTHER PUBLICATIONS

English translation of Abstract for DE 3802886 (see "DE3802886_Abstract.pdf").*
English Abstract of DE 3802886.

*Primary Examiner* — Noah Kamen
*Assistant Examiner* — Long T Tran
(74) *Attorney, Agent, or Firm* — Dykema Gossett PLLC

(57) ABSTRACT

A cylinder head (1) for an internal combustion engine with liquid cooling and a liquid-cooled exhaust manifold (8) and which is arranged integrally with the cylinder head (1) includes at least one first and one second cooling chamber (4, 9) through which a coolant flows, and with the region of the exhaust manifold (8) being enclosed at least partly by the second cooling chamber. In order to ensure by way of simple production the optimal removal of heat from thermally critical regions, the first and second cooling chambers are flow-connected via at least one borehole (10) with one another.

9 Claims, 4 Drawing Sheets

(56) References Cited

U.S. PATENT DOCUMENTS

| | | | | | |
|---|---|---|---|---|---|
| 3,769,948 | A | * | 11/1973 | Feichtinger et al. | 123/41.31 |
| 4,082,068 | A | * | 4/1978 | Hale | 123/41.02 |
| 4,377,990 | A | | 3/1983 | Seidl | |
| 4,834,030 | A | | 5/1989 | Bauer et al. | |
| 5,765,282 | A | * | 6/1998 | Sweetland et al. | 29/888.06 |
| 5,970,926 | A | | 10/1999 | Tsunoda et al. | |
| 6,928,964 | B2 | * | 8/2005 | Obermayer et al. | 123/41.82 R |
| 7,051,685 | B2 | | 5/2006 | Hayman et al. | |
| 7,056,170 | B2 | * | 6/2006 | Tawa et al. | 440/88 R |
| 7,069,882 | B2 | * | 7/2006 | Yonezawa et al. | 123/41.72 |
| 2005/0087154 | A1 | | 4/2005 | Hayman et al. | |
| 2009/0255490 | A1 | * | 10/2009 | Poschl et al. | 123/41.82 R |

* cited by examiner

CYLINDER HEAD FOR AN INTERNAL COMBUSTION ENGINE

BACKGROUND OF THE INVENTION

1. Field of the Invention

The invention relates to a cylinder head for an internal combustion engine with liquid cooling and a liquid-cooled exhaust manifold which is arranged integrally with the cylinder head, with the cylinder head comprising at least one first cooling chamber and one second cooling chamber through which a coolant flows, and with the region of the exhaust manifold being enclosed at least partly by the second cooling chamber.

2. The Prior Art

It is known from US 2005/0087154 A1 to arrange the exhaust manifold integrally with the cylinder head. The main cooling chamber which is formed by an upper and a lower partial cooling chamber is thermally connected with the exhaust manifold.

EP 0 856 650 A1 shows a cooling system for an outboard engine, with the exhaust ports originating from the combustion chamber being curved in a U-shaped manner in the cylinder head and the flange areas for connecting an exhaust manifold are disposed in the cylinder head plane. The exhaust manifold is integrally arranged with the cylinder housing.

U.S. Pat. No. 7,051,685 B2 discloses a cylinder head with an integrated exhaust manifold, with the exhaust manifold being enclosed by a first and second cooling chamber, with the two cooling chambers being connected with one another by co-cast flow connections. The first and second cooling chambers are arranged on top of one another.

AT 500 442 B1 describes a cylinder head for an internal combustion engine with liquid cooling with a first central cooling chamber and a second cooling chamber which encloses an integrated exhaust manifold, with the coolant flow through the second cooling chamber being separately adjustable from the coolant flow through the first cooling chamber.

SUMMARY OF THE INVENTION

It is the object of the invention to ensure sufficient cooling of the exhaust manifold and thermally highly loaded areas of the fire deck in a cylinder head of the kind mentioned above by way of simple production.

This is achieved in accordance with the invention such a way that the first and the second cooling chamber are flow-connected with one another via at least one borehole.

Since the flow connection between the first and the second cooling chamber occurs via boreholes, a simple and thermally optimal configuration of the first and second cooling chamber can be achieved, with preferably at least one borehole being provided per cylinder. Since the cores of the first and second cooling chamber are separate from one another from a casting standpoint, relevant advantages are obtained in production by casting.

Especially good cooling of thermally highly loaded areas can be achieved when the borehole is arranged in the fire deck, especially parallel to the cylinder head gasket area. It is especially advantageous when the borehole is arranged between at least one intake valve and at least one exhaust valve of a cylinder, preferably between an intake opening and an outlet opening. It can further be provided that the borehole is arranged between at least one exhaust valve and an injection device or ignition device of a cylinder, preferably between an outlet opening and an orifice of the injection device or ignition device.

It is provided in an embodiment of the invention which is especially simple from a production standpoint that the borehole originates from an opening on the outlet side in an outside wall of the second cooling chamber, with the opening preferably being sealable by a plug. In order to optimally cool thermally highly loaded areas between the orifice of the injection device or ignition device and the exhaust valve seat, it is preferably provided that the borehole opens up an angle of ≤90°, preferably ≤70°, with a plateau formed by the cylinder axes.

The first cooling chamber can predominantly be arranged on the intake side and the second cooling chamber at least predominantly on the outlet side of the cylinder head.

BRIEF DESCRIPTION OF THE DRAWINGS

The invention will be explained below in greater detail by reference to the drawings, wherein.

DETAILED DESCRIPTION IF THE PREFERRED EMBODIMENT

Figure 1:
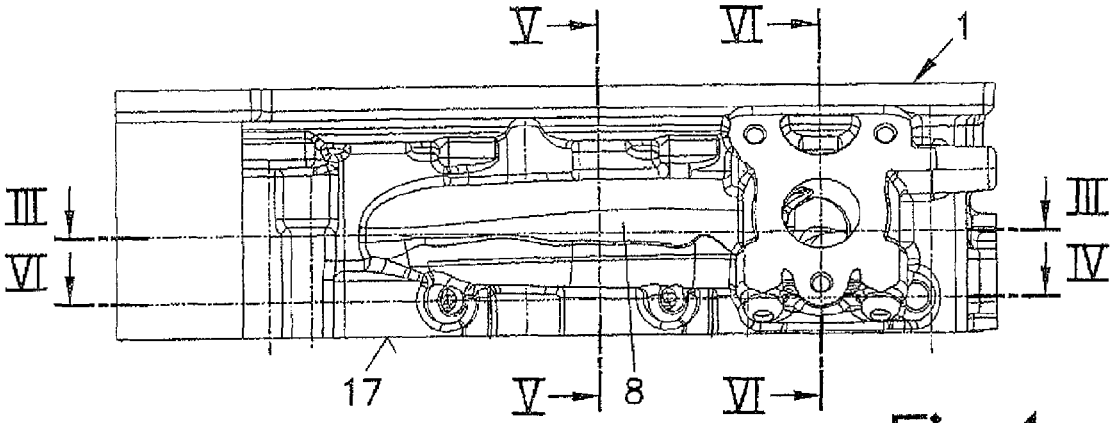
FIG. 1 shows a cylinder head in accordance with the invention in a side view.
Figure 2:
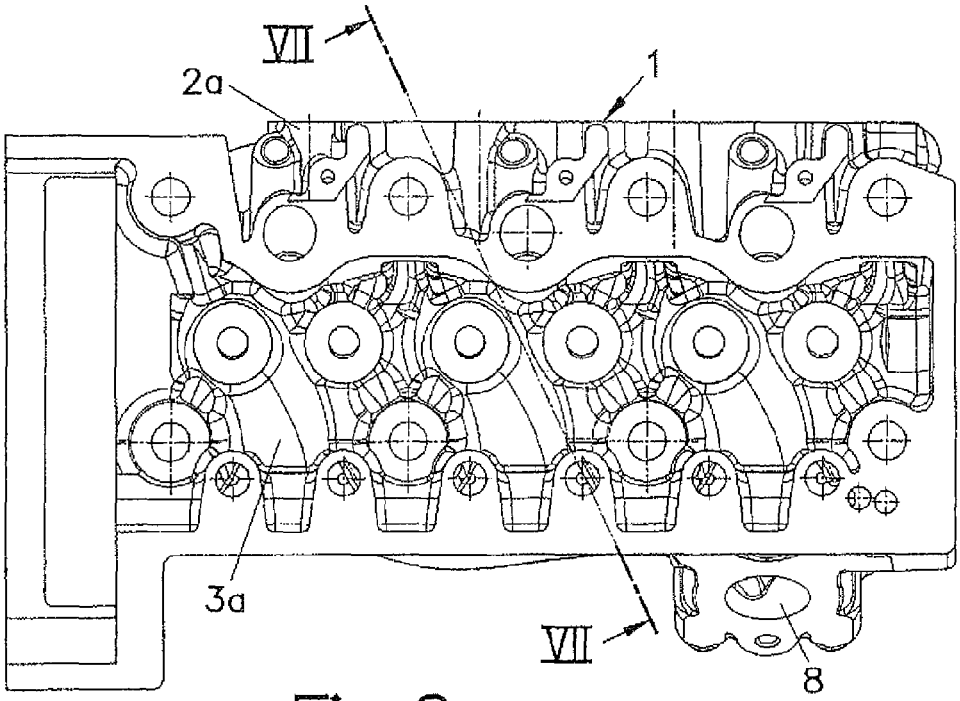
FIG. 2 shows the cylinder head in a top view.
Figure 3:
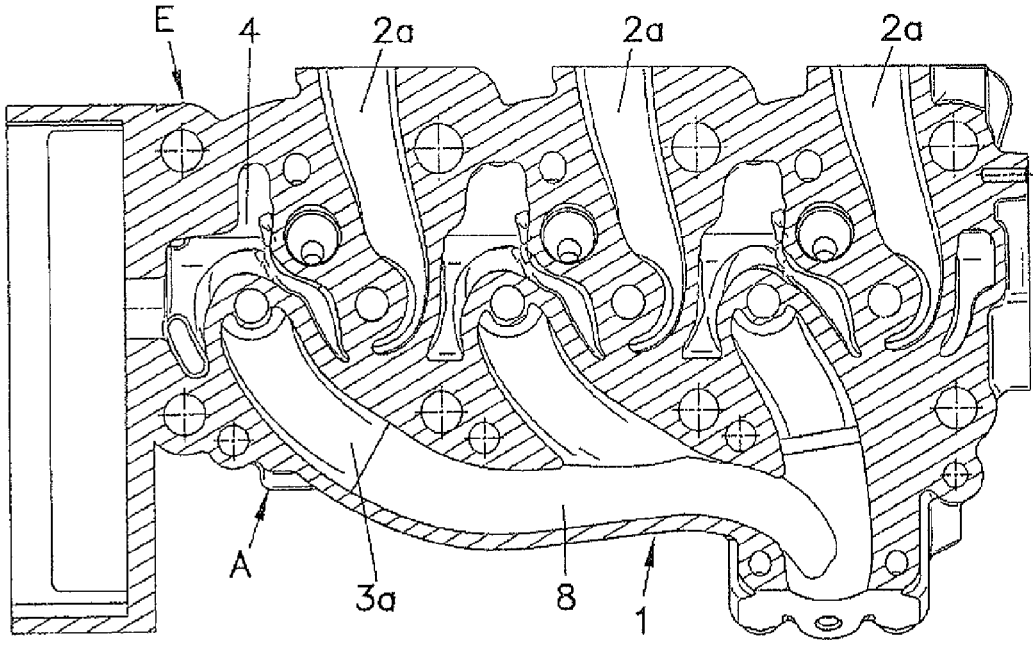
FIG. 3 shows the cylinder head in a sectional view along the line in FIG. 1.

The drawings show a cylinder head 1 for an internal combustion engine with one intake valve and one exhaust valve per cylinder, with the intake openings being indicated in the drawings with reference numeral 2 and the outlet openings with reference numeral 3. Reference numeral 2*a* indicates the intake ports and reference numeral 3*a* the exhaust ports. The exhaust ports 3*a* open into an exhaust manifold 8 which is integrally formed with the cylinder head 1.

The cylinder head 1 comprises a first cooling chamber 4 which forms the main cooling jacket for cooling thermally critical regions adjacent to the combustion chamber, with the first cooling chamber 4 being connectable via coolant openings 5 in the fire deck 7 with a cooling jacket of a cylinder block (not shown in closer detail).

The exhaust manifold 8 which is integrally arranged with the cylinder head 1 is enclosed at least partly by the second cooling chamber 9. The second cooling chamber 9 is substantially separated from the first cooling chamber 4 and is flow-connected with the same only via boreholes 10 which are arranged in the fire deck 7. The second cooling chamber 9 is connectable via separate transfer openings 6 with the cooling jacket of the cylinder block.

The boreholes 10 are respectively arranged between an intake valve and an exhaust valve of a cylinder, especially between an intake opening 2 and an outlet opening 3. The borehole 10 can also be arranged between an exhaust valve and an injection device or ignition device opening into a combustion chamber, especially between the outlet opening 3 and the orifice 11 of the injection device or ignition device into the combustion chamber, as is shown in particular detail in FIG. 11. The borehole 10 is arranged substantially parallel to the cylinder head gasket plane 17 and opens up an angle of $\alpha \leq 90°$, especially $\leq 70°$, with a plateau $\epsilon$ formed by the cylinder axes. An especially good removal of heat from the thermally critical regions of the fire deck 7 can be ensured thereby.

As is shown in the drawings, the first cooling chamber 4 is substantially arranged on the intake side E and the second cooling chamber 9 substantially on the outlet side A of the cylinder head 1. Especially simple production can be achieved when the boreholes 10 originate from an outside wall 12 on the outlet side of the second cooling chamber 9. The openings 13 in the outside wall 12 can subsequently be sealed by a plug.

Figure 4:
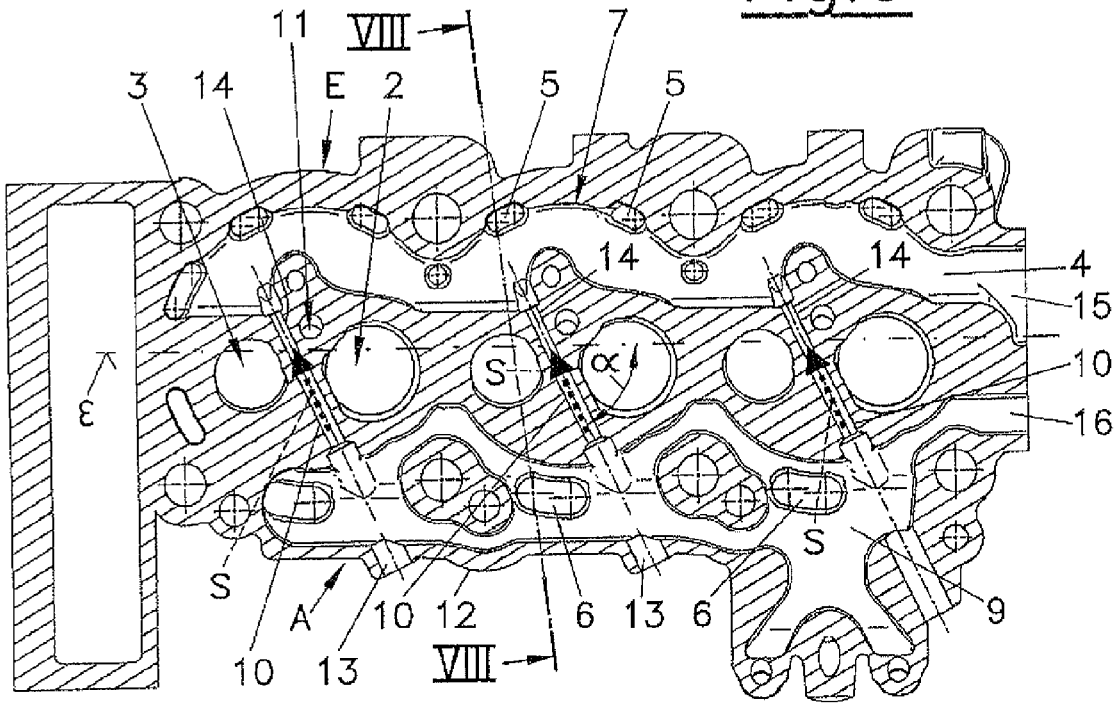
FIG. 4 shows the cylinder head in a sectional view along the line IV-IV in FIG. 1.
Figure 5:
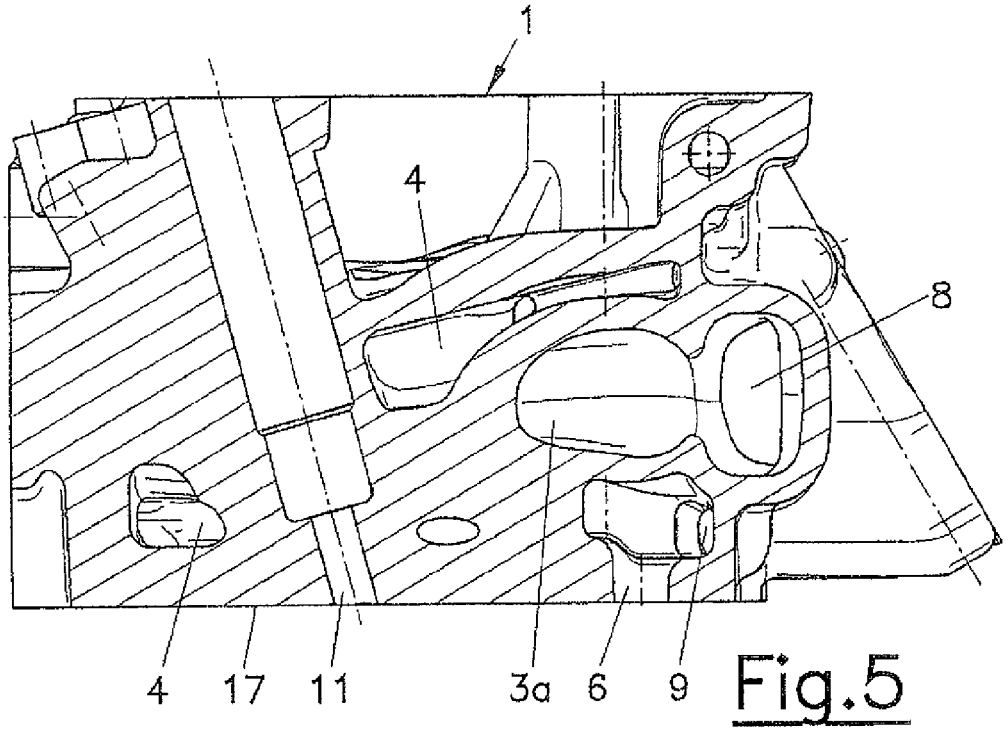
FIG. 5 shows the cylinder head in a sectional view along the line V-V in FIG. 1.
Figure 6:
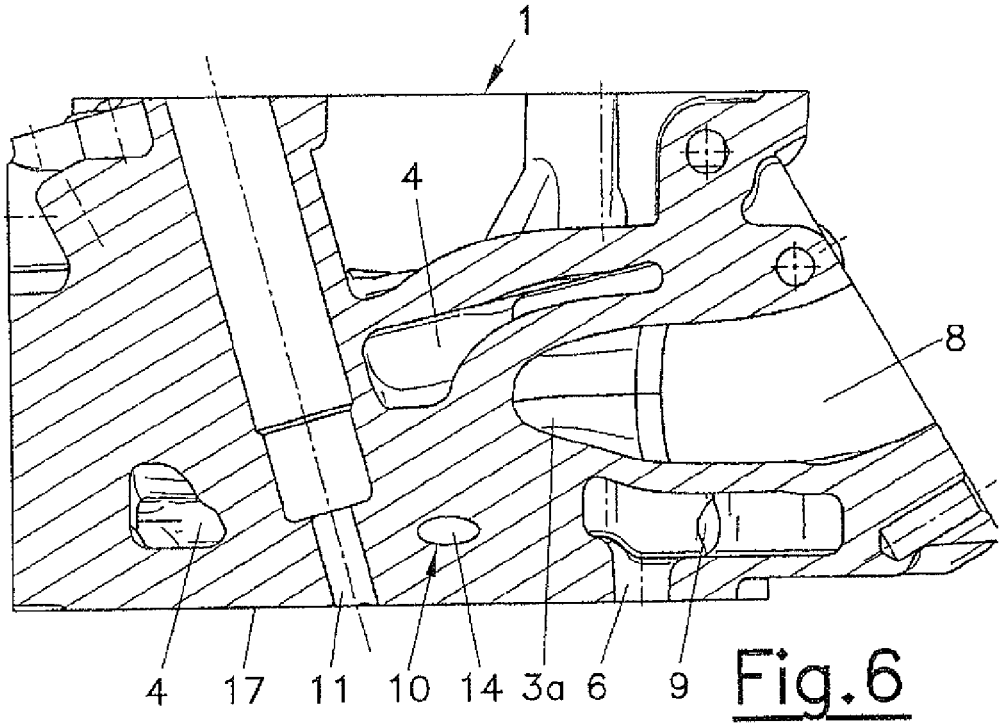
FIG. 6 shows the cylinder head in a sectional view along the line VI-VI in FIG. 1.
Figure 7:
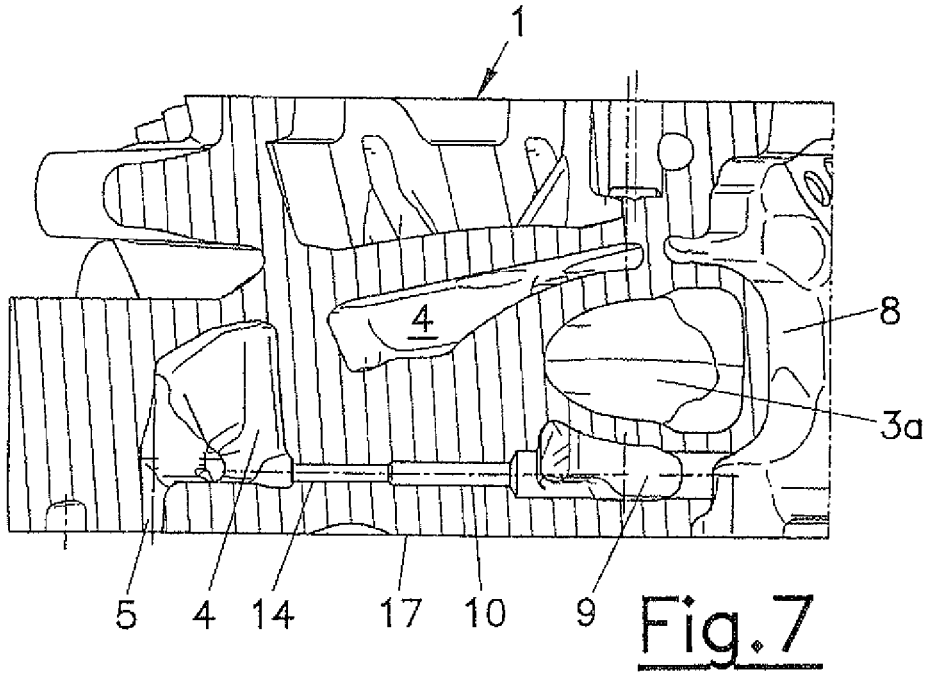
FIG. 7 shows the cylinder head in a sectional view along the line VII-VII in FIG. 2.
Figure 8:
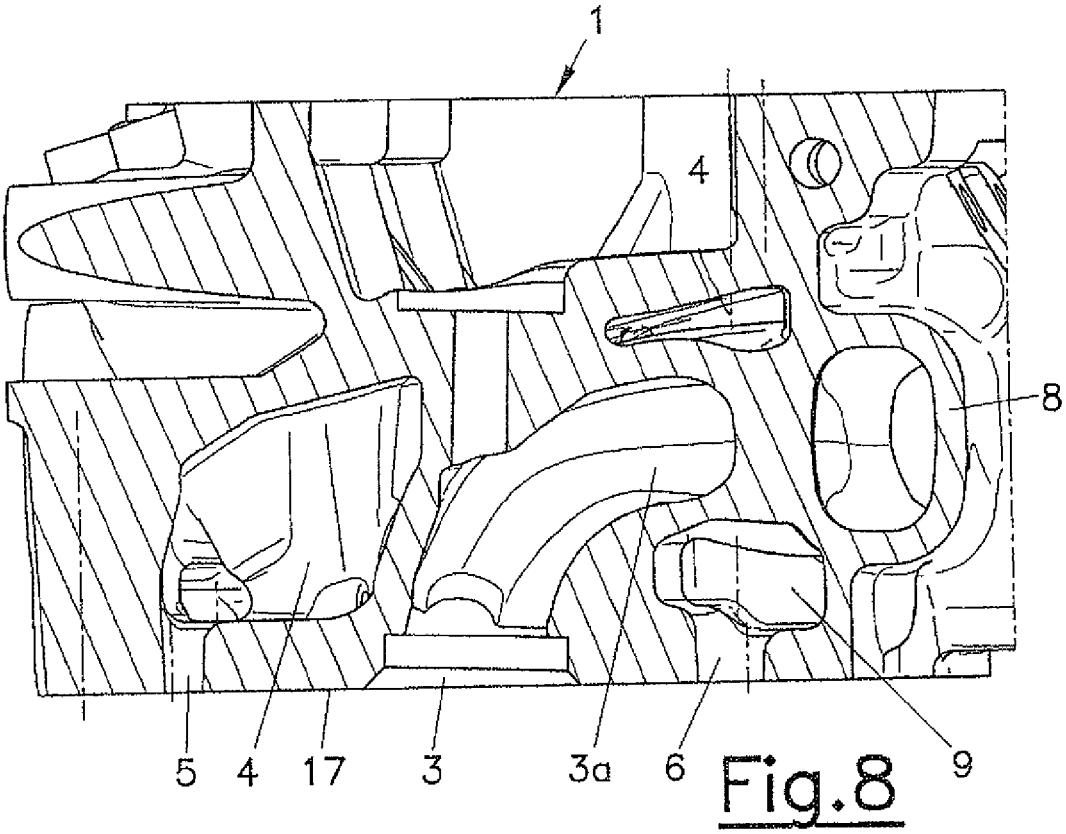
FIG. 8 shows the cylinder head in a sectional view along the line VIII-VIII in FIG. 4.

As is shown in FIG. 4, the borehole may comprise a throttling point 14 of a defined cross-section. The quantity of the coolant transferred between the second and the first cooling chamber 9, 4 can be set via the cross-section of the throttling point 14.

The coolant flows from the cooling jacket of the cylinder block (not shown in closer detail) via the transfer openings 5, 6 into the first and second cooling chamber 4, 9. A portion of the coolant flows according to the arrows S from the second cooling chamber 9 into the first cooling chamber 4, with thermally critical regions being cooled in an optimal manner. After the cooling of thermally critical regions in the fire deck 7 and in the region of the exhaust manifold 8, the coolant of the first cooling chamber 4 and the second cooling chamber 9 leaves the cylinder head 1 through the openings 15 and 16 arranged in the face side.

The invention claimed is:

1. A cylinder head for an internal combustion engine with liquid cooling and a liquid-cooled exhaust manifold which is arranged integrally with the cylinder head, with the cylinder head comprising a first and a second cooling chamber through which a coolant flows, and with a region of the exhaust manifold being enclosed at least partly by the second cooling chamber, wherein the cylinder head includes a borehole which extends between the first and second cooling chambers to enable coolant flow therebetween, and wherein the borehole extends between an intake valve and an exhaust valve of a cylinder.

2. The cylinder head according to claim 1, wherein the cylinder head provides multiple cylinders and includes a borehole per cylinder.

3. The cylinder head according to claim 1, wherein the borehole extends between an exhaust valve and an injection or ignition device of a cylinder.

4. The cylinder head according to claim 3, wherein the borehole extends between an outlet opening of a cylinder and an orifice of the injection or ignition device.

5. A cylinder head according to claim 1, wherein the borehole is arranged substantially parallel to a cylinder head gasket area.

6. The cylinder head according to claim 1, wherein the borehole originates from an opening on the outlet side of an outside wall of the second cooling chamber.

7. The cylinder head according to claim 1, wherein the first cooling chamber is located at least predominantly on an intake side and the second cooling chamber at least predominantly on an outlet side.

8. The cylinder head according to claim 1, wherein the borehole opens up an angle of $(\alpha) \leq 90°$ with a plateau $(\epsilon)$ formed by at least two cylinder axes.

9. The cylinder head according to claim 8, wherein said angle is less than or equal to 70°.

* * * * *